US007601185B2

(12) United States Patent
Schwahn et al.

(10) Patent No.: US 7,601,185 B2
(45) Date of Patent: Oct. 13, 2009

(54) FUEL ADDITIVE MIXTURES FOR GASOLINES WITH SYNERGISTIC IVD PERFORMANCE

(75) Inventors: Harald Schwahn, Wiesloch (DE); Dietmar Posselt, Heidelberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 625 days.

(21) Appl. No.: 10/505,767

(22) PCT Filed: Mar. 5, 2003

(86) PCT No.: PCT/EP03/02253

§ 371 (c)(1),
(2), (4) Date: Aug. 26, 2004

(87) PCT Pub. No.: WO03/074637

PCT Pub. Date: Sep. 12, 2003

(65) Prior Publication Data

US 2005/0155280 A1 Jul. 21, 2005

(30) Foreign Application Priority Data

Mar. 6, 2002 (DE) ..... 102 09 830

(51) Int. Cl.
*C10L 1/18* (2006.01)
*C10L 1/22* (2006.01)

(52) U.S. Cl. ..... 44/412; 44/443

(58) Field of Classification Search ..... 44/412, 44/443

See application file for complete search history.

(56) References Cited

U.S. PATENT DOCUMENTS

| | | | | |
|---|---|---|---|---|
| 4,832,702 | A | 5/1989 | Kummer et al. | |
| 4,849,572 | A | 7/1989 | Chen et al. | |
| 4,877,416 | A | 10/1989 | Campbell | |
| 5,004,478 | A | 4/1991 | Vogel et al. | |
| 5,006,130 | A | 4/1991 | Aiello et al. | |
| 5,112,364 | A | 5/1992 | Rath et al. | |
| 5,298,039 | A | 3/1994 | Mohr et al. | |
| 5,518,511 | A | 5/1996 | Russell et al. | |
| 5,660,601 | A | 8/1997 | Oppenländer et al. | |
| 5,746,786 | A | 5/1998 | Mueller et al. | |
| 5,879,420 | A | 3/1999 | Kropp et al. | |
| 5,972,856 | A | 10/1999 | Kropp et al. | |
| 5,980,594 | A | 11/1999 | Kropp et al. | |
| 5,993,499 | A * | 11/1999 | Houser | 44/412 |
| 6,005,144 | A | 12/1999 | Kropp et al. | |
| 6,069,281 | A | 5/2000 | Kropp et al. | |
| 6,140,541 | A | 10/2000 | Melder et al. | |
| 6,579,329 | B1 * | 6/2003 | Thomas et al. | 44/388 |
| 2003/0140552 | A1 | 7/2003 | Schwahn et al. | |

FOREIGN PATENT DOCUMENTS

| | | | |
|---|---|---|---|
| CA | 2 050 967 | | 12/2003 |
| DE | A 38 38 918 | | 5/1990 |
| DE | A 196 20 262 | | 11/1997 |
| EP | A 0 244 616 | | 11/1987 |
| EP | 0 310 875 | A1 | 9/1988 |
| EP | A 356 725 | | 3/1990 |
| EP | 0 374 461 | | 6/1990 |
| EP | A 476 485 | | 3/1992 |
| EP | A 0 548 617 | | 6/1993 |
| EP | 0 578 323 | A2 | 1/1994 |
| EP | 0 639 632 | A1 | 6/1994 |
| EP | A 700 985 | | 3/1996 |
| EP | 0 704 519 | A1 | 4/1996 |
| EP | 704519 | * | 4/1996 |
| EP | A 0 706 553 | | 4/1996 |
| EP | 0 831 141 | A1 | 3/1998 |
| EP | 0 878 532 | A1 | 11/1998 |
| EP | 0 887 400 | A1 | 12/1998 |
| WO | WO 87/01126 | | 2/1987 |
| WO | WO 93/20170 | | 10/1993 |
| WO | WO A 94/24231 | | 10/1994 |
| WO | WO 95/29974 | | 11/1995 |
| WO | WO A 96/03367 | | 2/1996 |
| WO | WO A 96/03479 | | 2/1996 |
| WO | WO A 97/03946 | | 2/1997 |
| WO | WO 00/02978 | | 1/2000 |
| WO | WO 01/85874 | | 11/2001 |

* cited by examiner

*Primary Examiner*—Cephia D Toomer
(74) *Attorney, Agent, or Firm*—Nixon & Vanderhye P.C.

(57) ABSTRACT

Novel fuels for gasoline engines comprise a synergistic mixture of a detergent additive component (A) and a synthetic carrier oil component (B), i) the detergent additive component (A) comprising at least one compound having a basic nitrogen atom which is substituted by a hydrocarbyl radical having a number average molecular weight of from about 500 to 1 300, and the detergent additive component (A) being contained in the fuel in an amount of from about 30 to 180 ppm by weight; and ii) the carrier oil component (B) comprising at least one compound of the following formula I $$R—O-(A-O)_x—H \quad (I)$$

where
R is a straight-chain or branched $C_6$-$C_{18}$-alkyl group;
A is a $C_3$- or $C_4$-alkylene group; and
x is an integer from 5 to 35;

the carrier oil component (B) being contained in the fuel in an amount of from about 10 to 180 ppm by weight.

22 Claims, No Drawings

FUEL ADDITIVE MIXTURES FOR GASOLINES WITH SYNERGISTIC IVD PERFORMANCE

This application is the US national phase of international application PCT/EP03/02253 filed 5 Mar. 2003 which designated the U.S. and claims benefit of DE 102 09 830.1, dated 6 Mar. 2002, the entire content of which is hereby incorporated by reference.

The present invention relates to synergistic gasoline fuel additive compositions having a synergistic performance in keeping the intake system clean, and gasoline engine fuels to which said compositions have been added.

Carburetors and intake systems of gasoline engines, but also injection systems for fuel metering, are increasingly being contaminated by impurities which are caused by dust particles from the air, uncombusted hydrocarbon residues from the combustion chamber and the crank case vent gases passed into the carburetor.

These residues shift the air/fuel ratio during idling and in the lower part-load range so that the mixture becomes leaner, the combustion becomes more incomplete and in turn the proportions uncombusted or partially combusted by hydrocarbons in the exhaust gas become larger and the gasoline consumption increases.

It is known that fuel additives for keeping valves and carburetors or injection systems of gasoline engines clean are used for avoiding these disadvantages (cf. for example: M. Rossenbeck in Katalysatoren, Tenside, Mineralöladditive, edited by J. Falbe and U. Hasserodt, page 223, G. Thieme Verlag, Stuttgart 1978).

Depending on the mode of action, but also on the preferred site of action, of such detergent additives, a distinction is now made between two generations.

The first additive generation was able only to prevent the formation of deposits in the intake system but not to remove existing deposits, whereas the modern additives of the second generation can do both (keep-clean and clean-up effect) and, owing to their excellent heat stability, can also do so in particular in zones of high temperature, i.e. in the intake valves. Such detergents, which can originate from a large number of classes of chemical substances, for example polyalkeneamines, polyetheramines, polybutene Mannich bases or polybutenesuccinimides, are used in general in combination with carrier oils and in some cases further additive components, for example corrosion inhibitors and demulsifiers. The carrier oils perform a solvent and wash function in combination with the detergents. Carrier oils are, as a rule, high-boiling, viscous, thermally stable liquids which coat the hot melt surface and thus prevent the formation or deposition of impurities on the metal surface.

Such formulations of detergents with carrier oils can in principle be specified as follows (depending on the type of the carrier oil or carrier oils:

a) mineral oil-based (i.e. only mineral oil-based (mineral) carrier oils are used),
b) completely synthetic (i.e. only synthetic carrier oils are used) or, used in minor amounts,
c) semisynthetic (i.e. mixtures of mineral oil-based and synthetic carrier oils are used).

It is known from the prior art that the additive formulations described are used in gasoline fuels. It is generally considered that completely synthetic additive packets have somewhat better keep-clean properties than mineral oil-based ones.

EP-A-0 704 519 describes additive mixtures for fuels, comprising at least one amine with a hydrocarbon radical having an average molecular weight of from 500 to 10 000, at least one hydrocarbon polymer having an average molecular weight of from 300 to 10 000 in hydrogenated or unhydrogenated form and, as a carrier oil component, a mixture of polyethers based on propylene oxide and/or butylene oxide and esters of mono- or polycarboxylic acids and alkanols or polyols. In a comparative example disclosed therein, polyisobutenamine (molecular weight about 1 000) and an isotridecanol, reacted with 22 mol of butylene oxide, are added in amounts of, in each case, 300 ppm to gasoline fuel. There is no reference in this document to a possible synergistic reaction between carrier oil and detergent additive.

EP-A-0 548 617 describes gasoline fuels to which an additive combination comprising from 10 to 5 000 ppm of a nitrogen-containing detergent additive and from 10 to 5 000 ppm of a phenol-initiated propoxylate have been added. In an individual comparative example, a mixture of polyisobutylamine and an alcohol butoxylate not defined in more detail is described. In each case 200 ppm of these two components are added to a fuel. There is no reference to a possible synergistic interaction between these two components in the stated amounts.

EP-A-0 374 461, corresponding to U.S. Pat. No. 5,004,478, describes gasoline fuels to which has been added a mixture of from 50 to 1 000 ppm of nitrogen-containing detergent additive and from 50 to 5 000 ppm of a carrier oil mixture of a) a polyalkylene oxide based on propylene oxide and/or butylene oxide and having a molar mass of at least 500, which was prepared with aliphatic or aromatic mono-, di- or polyalcohols, amines or amides or with alkylphenols as an initiator molecule, and b) esters of monocarboxylic acids or polycarboxylic acids and alkanols or polyols, these esters having a minimum viscosity of 2 $cm^2/s$ at 100° C. Once again, no reference is made to a synergistic interaction between detergent additive and polyether component in this publication.

EP-A-0 706 553 describes fuel additive compositions comprising a hydrocarbon-substituted amine having a molecular weight of from about 700 to 2 000, a polyolefin polymer of a $C_2$-$C_6$-monoolefin having a molecular weight of from about 350 to 2 000 and a poly(oxyalkylene)monool having a terminal hydrocarbon group and an average molecular weight of from about 500 to 5 000, the terminal hydrocarbon group being a $C_1$-$C_{30}$-hydrocarbyl group. Specific examples of such polyether components are dodecylphenol-initiated poly(oxy)butylenes having a molecular weight of about 1 500 which are preferably used in combination with a polyisobutenamine having a molecular weight of 1 300. Alkanol-initiated polyether compounds and their combined use with detergent additives are not described in this publication.

EP-A-0 887 400 describes gasoline fuel mixtures to which from 50 to 70 ppm of N-containing detergent having a molecular weight of from 700 to 3 000 and from 35 to 75 ppm of hydrocarbyl-terminated poly(oxyalkylene)monool having a molecular weight of from 500 to 5 000 have been added. Preferred hydrocarbyl terminal groups are $C_7$-$C_{30}$-alkylphenyl groups, in particular dodecylphenyl.

However, the additive packets known to date require further optimization.

It is an object of the present invention to provide, for gasoline fuels, fuel additive packets which have very good keep-clean effects in the intake system.

We have found that this object is achieved and that, according to the invention, formulations for gasoline fuels can be provided by the choice of defined mixtures of synthetic carrier oils and detergent additives, which formulations cooperate synergistically in a particularly advantageous manner and are particularly effective in cleaning the intake system.

The present invention firstly relates to fuels for gasoline engines, comprising a synergistic mixture of a detergent additive component (A) and a synergistic carrier oil component (B), i) the detergent additive component (A) comprising at least one compound having a basic nitrogen atom which is substituted by a hydrocarbyl radical having a number average molecular weight of from about 500 to 1 300, and the detergent additive component (A) being present in the fuel in an amount of from about 30 to 180 ppm by weight, and ii) the carrier oil component (B) comprising at least one compound of the following formula I $$R—O-(A-O)_x—H \quad (I)$$

where

R is a straight-chain or branched $C_6$-$C_{18}$-alkyl group,

A is a $C_3$- or $C_4$-alkylene group and x is an integer from 5 to 35, the carrier oil component (B) being present in the fuel in an amount of from about 10 to 180 ppm by weight.

Fuels comprising component (A) in an amount of from 50 to 150, in particular from 70 to 130, ppm by weight and fuels comprising component (B) in an amount of from 20 to 150, in particular from 50 to 130, ppm by weight are preferably provided.

According to a further preferred variant, the novel fuels comprise a polyisobutenamine as component (A). Preferably, component (B) is a compound of the formula I, where R is a straight-chain or branched $C_8$-$C_{15}$-alkyl group, A is butylene and/or x is an integer from 16 to 25, in particular from 20 to 24. An isotridecanol butoxylate is particularly preferably used as component (B).

The present invention furthermore relates to the use of a synergistic additive combination according to the above definition as gasoline fuel additive for cleaning the engine intake system.

A detailed description of the invention follows.

1. Detergent Additive Component (A)

Fuel additive compositions preferred according to the invention comprise, as a detergent additive component (component A), a detergent additive selected from polyalkenemonoamines and polyalkenepolyamines and mixtures thereof. Examples of polyalkenamines which may be used are poly-$C_2$-$C_6$-alkenamines and functional derivatives thereof, which in each case contain a hydrocarbyl radical having a preferred Mn of from about 500 to 1 500, preferably from about 600 to 1 200, in particular from about 700 to 1 100, g. In addition to ammonia, suitable amines include mono- and di-$C_1$-$C_6$-alkylamines, such as mono- and dimethylamine, mono- and diethylamine, mono- and di-n-propylamine, mono- and di-n-butylamine, mono- and di-sec-butylamine, mono- and di-n-pentylamine, mono- and di-2-pentylamine, mono- and di-n-hexylamine, etc. Further suitable amines are diamines, such as ethylenediamine, propylene 1,2-diamine, propylene 1,3-diamine, butylenediamines and the mono-, di- and trialkyl derivatives of these amines. It is also possible to use, as polyamines, polyalkylenepolyamines which have up to 6 nitrogen atoms and whose alkylene radicals are of 2 to 6 carbon atoms, such as diethylenetriamine, triethylenetetramine and tetraethylenepentamine. Also suitable are mono- or dialkylamines in which the alkyl radicals may be interrupted by one or more nonneighboring oxygen atoms and which may also have hydroxyl groups. These include, for example, ethanolamine, 3-aminopropanol, 2-(2-aminoethoxy)ethanol and N-(2-aminoethyl)ethanolamine.

Polyalkenemonoamines or polyalkenepolyamines which can be used in particular according to the invention or functional derivatives thereof are in particular poly-$C_2$-$C_6$-alkenamines, such as poly-$C_3$- or $C_4$-alkenamines, or functional derivatives thereof, e.g. compounds having a hydrocarbyl radical, prepared by polymerization of ethylene, propene, 1- or 2-butene, isobutene or mixtures thereof.

Examples of functional derivatives of the above additives are compounds which carry one or more polar substituents, in particular hydroxyl groups, for example in the amine moiety.

Preferred additives which can be used according to the invention are polyalkenemonoamines or polyalkenepolyamines based on polypropene or on highly reactive (i.e. having predominantly terminal double bonds) or conventional (i.e. having predominantly internal double bonds) polybutene or polyisobutene.

Particularly suitable polyisobutenes are highly reactive polyisobutenes which have a high content of terminal ethylenic double bonds. Suitable highly reactive polyisobutenes are, for example, polyisobutenes which contain more than 70, in particular more than 80, especially more than 85, mol % of vinylidene double bonds. Polyisobutenes which have uniform polymer skeletons are particularly preferred. Uniform polymer skeletons are possessed in particular by those polyisobutenes which are composed of at least 85, preferably at least 90, particularly preferably at least 95, % by weight of isobutene units. Such highly reactive polyisobutenes preferably have a number average molecular weight $M_N$ in the abovementioned range. In addition, the highly reactive polyisobutenes may have a polydispersity of less than 1.9, e.g. less than 1.5. Polydispersity is understood as meaning the quotient of weight average molecular weight $M_W$ and number average molecular weight $M_N$.

Such additives based on highly reactive polyisobutene which can be prepared from polyisobutene which may contain up to 20% by weight of n-butene units by hydroformylation and reductive amination with ammonia, monoamines or polyamines, such as dimethylaminopropylamine, ethylenediamine, diethylenetriamine, triethylenetetramine and tetraethylenepentamine, are disclosed in particular in EP-A-0 244 616 or EP-A-0 578 323.

If polybutene or polyisobutene having predominantly internal double bonds (generally in the beta- and gamma-positions) is used as the starting material in the preparation of the additives, the preparation by chlorination and subsequent amination or by oxidation of the double bond with air or ozone to give the carbonyl or carboxyl compound and subsequent amination under reductive (hydrogenating) conditions is possible. Here, the amines used for the amination may be the same as those used above for the reductive amination of the hydroformylated highly reactive polyisobutene. Corresponding additives based on polypropene are described in particular in WO-A-94/24231.

Further preferred monoamino-containing additives are the compounds obtainable from polyisobutene epoxides by reaction with amines and subsequent dehydration and reduction of the amino alcohols, as described in particular in DE-A 196 20 262.

Detergent additives of the polyalkeneamine type which may be used in particular are sold by BASF AG, Ludwigshafen, under the trade name Kerocom PIBA. These contain polyisobutenamines dissolved in aliphatic $C_{10}$-$C_{14}$-hydrocarbons and can be used as such in the novel additive packets.

The fuel additive mixtures used according to the invention can, if required, contain further gasoline fuel additives differing from (A) and having a detergent effect or an effect which inhibits valve seat wear (referred to below as detergent additives). These detergent additives have at least one hydrophobic hydrocarbon radical having a number average molecular weight ($M_N$) of from 85 to 20 000 and at least one polar group selected from:

(a) mono- or polyamino groups having up to 6 nitrogen atoms, at least one nitrogen atom having basic properties;

(b) nitro groups, if required in combination with hydroxyl groups;

(c) hydroxyl groups in combination with mono- or polyamino groups, at least one nitrogen atom having basic properties;

(d) carboxyl groups or the alkali metal or alkaline earth metal salts thereof;

(e) sulfo groups or the alkali metal or alkaline earth metal salts thereof;

(f) polyoxy-$C_2$- to $C_4$-alkylene groups which are terminated by hydroxyl groups or mono- or polyamino groups, at least one nitrogen atom having basic properties, or by carbamate groups;

(g) carboxylic ester groups;

(h) groups derived from succinic anhydride and having hydroxyl and/or amino and/or amido and/or imido groups; and (i) groups produced by Mannich reaction of substituted phenols with aldehydes and mono- or polyamines.

The hydrophobic hydrocarbon radical in the above detergent additives which ensures sufficient solubility in the fuel has a number average molecular weight ($M_N$) of from 85 to 20 000, in particular from 113 to 10 000, especially from 300 to 5 000. A typical hydrophobic hydrocarbon radical, in particular in combination with the polar groups (a), (c), (h) and (i), is the polypropenyl, polybutenyl or polyisobutenyl radical, having in each case an $M_N$ of from 300 to 5 000, in particular from 500 to 2 500, especially from 700 to 2 300.

The following are examples of the above groups of detergent additives:

Additives containing mono- or polyamino groups (a) are preferably polyalkenemonoamines or polyalkenepolyamines based on polypropene or on highly reactive (i.e. having predominantly terminal double bonds) or conventional (i.e. having predominantly internal double bonds) polybutene or polyisobutene having an $M_N$ of from 300 to 5 000. Such additives based on highly reactive polyisobutene, which can be produced from the polyisobutene, which may contain up to 20% by weight of n-butene units, by hydroformylation and reductive amination with ammonia, monoamines or polyamines, such as dimethylaminopropylamine, diethylenediamine, diethylenetriamine, triethylenetetramine or tetraethylenepentamine, are disclosed in particular in EP-A-244 616. If polybutene or polyisobutene having predominantly internal double bonds (generally in the beta- and gamma-positions) are used as a starting material in the preparation of the additives, the preparation by chlorination and subsequent amination or by oxidation of the double bond with air or ozone to give the carbonyl or carboxyl compound and subsequent amination under reductive (hydrogenating) conditions is possible. The amines which can be used here for the amination are the same as those used above for the reductive amination of the hydroformylated highly reactive polyisobutene. Corresponding additives based on polypropene are described in particular in WO-A-94/24231.

Further preferred additives containing monoamino groups (a) are the hydrogenation products of the reaction products of polyisobutenes having an average degree of polymerization P of from 5 to 100 with oxides of nitrogen or mixtures of oxides of nitrogen and oxygen, as described in particular in WO-A-97/03946.

Further preferred additives containing monoamino groups (a) are the compounds obtainable from polyisobutene epoxides by reaction with amines and subsequent dehydration and reduction of the amino alcohols, as described in particular in DE-A-196 20 262.

Additives containing nitro groups, if required in combination with hydroxyl groups, (b) are preferably reaction products of polyisobutenes having an average degree of polymerization P of from 5 to 100 or from 10 to 100 with oxides of nitrogen or mixtures of oxides of nitrogen and oxygen, as described in particular in WO-A-96/03367 and WO-A-96/03479. These reaction products are as a rule mixtures of pure nitropolyisobutanes (e.g. α,β-dinitropolyisobutane) and mixed hydroxynitropolyisobutanes (e.g. α-nitro-β-hydroxypolyisobutane).

Additives containing hydroxyl groups in combination with mono- or polyamino groups (c) are in particular reaction products of polyisobutene epoxides, obtainable from polyisobutene having preferably predominantly terminal double bonds and having an $M_N$ of from 300 to 5 000, with ammonia or mono- or polyamines, as described in particular in EP-A-476 485.

Additives containing carboxyl groups or the alkali metal or alkaline earth metal salts thereof (d) are preferably copolymers of $C_2$-$C_{40}$-olefins with maleic anhydride, having a total molar mass of from 500 to 20 000, some or all of whose carboxyl groups have been converted into the alkali metal or alkaline earth metal salts and a remainder of whose carboxyl groups have been reacted as alcohols or amines. Such additives are disclosed in particular in EP-A-307 815. Additives of this type serve mainly for preventing valve seat wear and, as described in WO-A-87/01126, can advantageously be used in combination with conventional fuel detergents, such as poly(iso)butenamines or polyetheramines.

Additives containing sulfo groups or the alkali metal or alkaline earth metal salts thereof (e) are preferably alkali metal or alkaline earth metal salts of an alkyl sulfosuccinate, as described in particular in EP-A-639 632. Additives of this type serve mainly for preventing valve seat wear and can advantageously be used in combination with conventional fuel detergents, such as poly(iso)butenamines or polyetheramines.

Additives containing polyoxy-$C_2$-$C_4$-alkylene groups (f) are preferably polyether or polyetheramines which are etheramines which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyetheramines, by subsequent reductive amination with ammonia, monoamines or polyamines. Products of this type are described in particular in EP-A-310 875, EP-A-356 725, EP-A-700 985 and U.S. Pat. No. 4,877,416. In the case of polyethers, such products also have carrier oil properties. Typical examples thereof are tridecanol butoxylates and isotridecanol butoxylates, isononylphenol butoxylates and polyisobutenol butoxylates and propoxylates and the corresponding reaction products with ammonia.

Additives containing carboxylic ester groups (g) are preferably esters of mono-, di- or tricarboxylic acids with long-chain alkanols or polyols, in particular those having a minimum viscosity of 2 $mm^2/s$ at 100° C., as described in particular in DE-A-38 38 918. Mono-, di- or tricarboxylic acids which may be used are aliphatic or aromatic acids, and particularly suitable ester alcohols or ester polyols are long-chain members of, for example, 6 to 24 carbon atoms. Typical members of the esters are adipates, phthalates, isophthalates, terephthalates and trimellitates of isooctanol, of isononanol, of isodecanol and of isotridecanol. Such products also have carrier oil properties.

Additives which contain groups derived from succinic anhydride and having hydroxyl and/or amino and/or amido and/or imido groups (h) are preferably corresponding derivatives of polyisobutenylsuccinic anhydride, which are obtainable by reacting conventional or highly reactive polyisobutene having an $M_N$ of from 300 to 5 000 with maleic anhydride by a thermal method or via the chlorinated polyisobutene. Of particular interest here are derivatives with aliphatic polyamines, such as ethylenediamine, diethylenetriamine, triethylenetetramine or tetraethylenepentamine. Such gasoline fuel additives are described in particular in U.S. Pat. No. 4,849,572.

Additives containing groups (i) produced by Mannich reaction of substituted phenols with aldehydes and mono- or polyamines are preferably reaction products of polyisobutenyl-substituted phenols with formaldehyde and mono- or polyamines, such as ethylenediamine, diethylenetriamine, triethylenetetramine, tetraethylenepentamine or dimethylaminopropylamine. The polyisobutenyl-substituted phenols may originate from conventional or highly reactive polyisobutene having an $M_N$ of from 300 to 5 000. Such polyisobutene Mannich bases are described in particular in EP-A-831 141.

For a more exact definition of the individual gasoline fuel additives mentioned, reference is made here expressly to the disclosures of the abovementioned publications of the prior art.

2. Carrier Oil Component (B)

The novel carrier oil component (B) comprises at least one compound of the following formula I $$R—O-(A-O)_x—H \quad (I)$$

where

R is a straight-chain or branched $C_6$-$C_{18}$-alkyl, in particular $C_8$-$C_{15}$-alkyl, group, A is a $C_3$- or $C_4$-alkylene group and x is an integer from 5 to 35, e.g. from 16 to 25 or from 20 to 24.

Examples of suitable radicals R are n-hexyl, n-heptyl, n-octyl, n-nonyl, n-decyl, n-undecyl, n-tridecyl, n-tetradecyl, n-pentadecyl, n-hexadecyl and n-octadecyl and the singly or multiply branched analogs thereof, such as isotridecyl, and mixtures of such isomers.

Examples of suitable radicals A are propylene, 1- and 2-butylene and isobutylene.

Examples of suitable polyethers (B) are preferably compounds which contain polyoxy-$C_2$-$C_4$-alkylene groups and are obtainable by reacting $C_6$-$C_{18}$-alkanols with from 5 to 35 mol of a $C_3$-$C_4$-alkylene oxide per hydroxyl group. Such products are described in particular in EP-A-0 310 875, EP-A-0 356 725, EP-A-0 700 985 and U.S. Pat. No. 4,877,416. Typical examples of these are tridecanol butoxylates or isotridecanol butoxylates and corresponding isomer mixtures thereof.

3. Further Additives

Further conventional additives for the novel fuels are corrosion inhibitors, for example based on ammonia salts of organic carboxylic acids, which salts tend to form films, or on heterocyclic aromatics in the case of inhibition of corrosion of nonferrous metals; antioxidants or stabilizers, for example based on amines, such as p-phenylenediamine, dicyclohexylamine or derivatives thereof, or on phenols, such as 2,4-tert-butylphenol or 3,5-di-tert-butyl-4-hydroxyphenylpropionic acid; demulsifiers; antistatic agents; metallocenes, such as ferrocene; methylcyclopentadienylmanganesetricarbonyl; lubricity additives, such as certain fatty acids, alkenylsuccinic esters, bis(hydroxyalkyl) fatty amines, hydroxyacetamides or castor oil; and markers. If required, amines may also be added for reducing the pH of the fuel.

The components or additives can be added to the gasoline fuel individually or as a previously prepared concentrate (additive packet), together with the novel high molecular weight polyalkene.

Said detergent additives differing from (A) and having polar groups (a) to (i) are added to the gasoline fuel usually in an amount of from 10 to 5 000, in particular from 50 to 1 000, ppm by weight. The other components and additives mentioned are, if desired, added in amounts customary for this purpose.

4. Gasoline Fuels

The novel additive compositions can be used in all conventional gasoline fuels, as described, for example, in Ullmann's Encyclopedia of Industrial Chemistry , 5th edition, 1990, Volume A16, page 719 et seq.

For example, use in a gasoline fuel having an aromatics content of not more than 42% by volume and a sulfur content of not more than 150 ppm by weight is possible.

The aromatics content of the gasoline fuel is, for example, from 30 to 42, preferably from 32 to 40, % by volume.

The sulfur content of the gasoline fuel is, for example, from 5 to 150, in particular from 10 to 100, ppm by weight.

The gasoline fuel has, for example, an olefin content of from 6 to 21, in particular from 7 to 18, % by volume.

The gasoline fuel may have, for example, a benzene content of from 0.5 to 1.0, in particular from 0.6 to 0.9, % by volume.

The gasoline fuel has, for example, an oxygen content of from 1.0 to 2.7, in particular from 1.2 to 2.0, % by weight.

In particular, those gasoline fuels which simultaneously have an aromatics content of not more than 38% by volume, an olefin content of not more than 21% by volume, a sulfur content of not more than 50 ppm by weight, a benzene content of not more than 1.0% by volume and an oxygen content of from 1.0 to 2.7% by weight may be mentioned by way of example.

The content of alcohols and ethers in the gasoline fuel is usually relatively low. Typical maximum contents are 3% by volume for methanol, 5% by volume for ethanol, 10% by volume for isopropanol, 7% by volume for tert-butanol, 10% by volume for isobutanol and 15% by volume for ethers having 5 or more carbon atoms in the molecule.

The summer vapor pressure of the gasoline fuel is usually not more than 70, in particular 60, kPa (in each case at 37° C.).

The RON of the gasoline fuel is as a rule from 90 to 100. A conventional range for the corresponding MON is from 80 to 90.

The stated specifications are determined by conventional methods (DIN EN 228).

The examples which follow illustrate the invention.

EXAMPLE

A mixture of equal parts of the detergent additive (PIBA=polyisobutenemonoamine ($M_W$=1 000)) and isotridecanol, etherified with 22 mol of butylene oxide, is prepared and is added to a commercial base fuel according to DIN EN 228 in different amounts. For comparison, only PIBA is added to the same fuel.

With these fuels and with additive-free fuel, a Mercedes Benz M 102 engine test is carried out for determining the intake system deposits (CEC F-05-A-93). The results are summarized in the table below.

The test results show that, in spite of a lower detergent additive content, the novel additive mixtures have a substantially better cleaning effect in the intake system.

TABLE 1

| Test No. | Additive | Dosage[3)] mg/kg | Valve deposit (mg/valve) 1 | 2 | 3 | 4 | Mean value |
|---|---|---|---|---|---|---|---|
| 1 | — | 0 | 293 | 593 | 296 | 338 | 380 |
| 2 | PIBA[1)] | 200 | 42 | 11 | 108 | 99 | 65 |
| 3 | PIBA[1)]/ Polyether[2)] | 100/100 | 5 | 25 | 100 | 52 | 46 |
| 4 | PIBA[1)]/ Polyether[2)] | 134/134 | 10 | 8 | 48 | 7 | 18 |

[1)]PIBA = Polyisobutenamine ($M_W$ = 1000)
[2)]Polyether = Isotridecanol, etherified with 22 1-butylene oxide units
[3)]Dosage based in each case on pure substance

We claim:

1. A method for cleaning an engine intake system comprising adding to gasoline fuel for the engine a gasoline fuel additive consisting of a synergistic mixture of a detergent additive component (A) and a synthetic carrier oil component (B), wherein i) the detergent additive component (A) is selected from the group consisting of at least one polyalkene monoamine which is substituted by a hydrocarbyl radical having a number average molecular weight of from about 500 to 1 300, the detergent additive component (A) being present in the fuel in an amount of from about 30 to 180 ppm by weight, and wherein ii) the carrier oil component (B) is selected from the group consisting of at least one compound of the following formula I $$R—O-(A-O)_x—H \quad (I)$$

where

R is a straight-chain or branched $C_6$-$C_{18}$-alkyl group;

A is a $C_4$-alkylene group and x is an integer from 5 to 35, the carrier oil component (B) being present in the fuel in an amount of from about 10 to 180 ppm by weight.

2. The method as claimed in claim 1, comprising component (A) in an amount of from 50 to 150 ppm by weight.

3. The method as claimed in claim 1, comprising component (A) in an amount of from 70 to 130 ppm by weight.

4. The method as claimed in claim 1, comprising component (B) in an amount of from 20 to 150 ppm by weight.

5. The method as claimed in claim 1, comprising component (B) in an amount of from 60 to 130 ppm by weight.

6. The method as claimed in claim 1, wherein component (A) is a polyisobutenamine.

7. The method as claimed in claim 1, wherein component (B) is a compound of the formula I, where R is a straight-chain or branched $C_8$-$C_{15}$-alkyl group.

8. The method as claimed in claim 1, wherein component (B) is a compound of the formula I, where A is butylene.

9. The method as claimed in claim 1, wherein component (B) is a compound of the formula I, where x is an integer from 16 to 25.

10. The method as claimed in claim 1, wherein component (B) is a compound of the formula I, where x is an integer from 20 to 24.

11. The method as claimed in claim 1, wherein component (B) is a tridecanol butoxylate.

12. A synergistic fuel additive mixture consisting of:

a synergistic mixture of a detergent additive component (A) and a synthetic carrier oil component (B), wherein i) the detergent additive component (A) is selected from the group consisting of at least one polyalkene monoamine which is substituted by a hydrocarbyl radical having a number average molecular weight of from about 500 to 1 300, the detergent additive component (A) being present in the fuel in an amount of from about 30 to 180 ppm by weight, and wherein ii) the carrier oil component (B) is selected from the group consisting of at least one compound of the following formula I $$R—O-(A-O)_x—H \quad (I)$$

where

R is a straight-chain or branched $C_6$-$C_{18}$-alkyl group;

A is a $C_4$-alkylene group and x is an integer from 5 to 35, the carrier oil component (B) being present in the fuel in an amount of from about 10 to 180 ppm by weight.

13. The fuel additive mixture as claimed in claim 12, comprising component (A) in an amount of from 50 to 150 ppm by weight.

14. The fuel additive mixture as claimed in claim 12, comprising component (A) in an amount of from 70 to 130 ppm by weight.

15. The fuel additive mixture as claimed in claim 12, comprising component (B) in an amount of from 20 to 150 ppm by weight.

16. The fuel additive mixture as claimed in claim 12, comprising component (B) in an amount of from 60 to 130 ppm by weight.

17. The fuel additive mixture as claimed in claim 12, wherein component (A) is a polyisobutenamine.

18. The fuel additive mixture as claimed in claim 12, wherein component (B) is a compound of the formula I, where R is a straight-chain or branched $C_8$-$C_{15}$-alkyl group.

19. The fuel additive mixture as claimed in claim 12, wherein component (B) is a compound of the formula I, where A is butylene.

20. The fuel additive mixture as claimed in claim 12, wherein component (B) is a compound of the formula I, where x is an integer from 16 to 25.

21. The fuel additive mixture as claimed in claim 12, wherein component (B) is a compound of the formula I, where x is an integer from 20 to 24.

22. The fuel additive mixture as claimed in claim 12, wherein component (B) is a tridecanol butoxylate.

* * * * *